US008261901B2

(12) United States Patent
Heidel

(10) Patent No.: US 8,261,901 B2
(45) Date of Patent: Sep. 11, 2012

(54) NOTE ACCEPTOR-DISPENSER VALIDATOR

(75) Inventor: Raymond Heidel, Las Vegas, NV (US)

(73) Assignee: JCM American Corporation, Las Vegas, NV (US)

( * ) Notice: Subject to any disclaimer, the term of this patent is extended or adjusted under 35 U.S.C. 154(b) by 1541 days.

(21) Appl. No.: 10/432,945

(22) PCT Filed: Feb. 27, 2001

(86) PCT No.: PCT/US01/06219

§ 371 (c)(1),
(2), (4) Date: Oct. 2, 2003

(87) PCT Pub. No.: WO02/43013

PCT Pub. Date: May 30, 2002

(65) Prior Publication Data

US 2004/0050651 A1 Mar. 18, 2004

(51) Int. Cl.
*G07F 7/04* (2006.01)
*G07F 9/10* (2006.01)
*B07C 5/00* (2006.01)

(52) U.S. Cl. ..... 194/206; 194/217; 194/350; 209/534

(58) Field of Classification Search ..... 194/206, 194/209, 215, 217, 302, 350; 235/379; 209/534; 700/215, 231, 232; 705/16, 17, 18, 21, 22, 705/23, 400; 902/8, 9, 11, 13, 14, 15, 22
See application file for complete search history.

(56) References Cited

U.S. PATENT DOCUMENTS

| | | | | |
|---|---|---|---|---|
| 4,325,277 | A * | 4/1982 | Uchida et al. | 83/205 |
| 4,540,081 | A * | 9/1985 | Mori et al. | 194/207 |
| 4,542,287 | A * | 9/1985 | Watanabe | 235/379 |
| 4,556,139 | A * | 12/1985 | Akagawa et al. | 194/207 |
| 4,747,492 | A * | 5/1988 | Saito et al. | 209/534 |
| 5,071,031 | A * | 12/1991 | Yuge et al. | 221/3 |
| 5,499,944 | A | 3/1996 | Weston et al. | |
| 5,566,807 | A * | 10/1996 | Morun | 194/217 |
| 5,718,318 | A * | 2/1998 | Wachter | 194/206 |
| 5,905,810 | A * | 5/1999 | Jones et al. | 382/135 |
| 5,975,275 | A * | 11/1999 | Keith et al. | 194/217 |
| 6,026,175 | A * | 2/2000 | Munro et al. | 382/135 |
| 6,241,069 | B1 * | 6/2001 | Mazur et al. | 194/207 |
| 6,318,536 | B1 * | 11/2001 | Korman et al. | 194/217 |
| 6,363,164 | B1 * | 3/2002 | Jones et al. | 382/135 |

(Continued)

FOREIGN PATENT DOCUMENTS

WO WO 99/22350 5/1999

*Primary Examiner* — Mark Beauchaine
(74) *Attorney, Agent, or Firm* — Watson Rounds; Marc D. Foodman

(57) ABSTRACT

An acceptor-dispenser validator system for accepting bills, vouchers, scrip and/or currency into, and for distributing currency or a currency equivalent from, an electronic gaming machine or alternative type of customer service device is disclosed. The system includes a note acceptor-dispenser assembly to be mounted in or on the machine, the note acceptor-dispenser having a note validator to sense the authenticity, denomination, amount and type of the note passing there through and issue a signal corresponding to the note type to the acceptor-dispenser's processor and the host machine's processor for accumulation of credits. A note box is provided to receive deposited notes as is a note hopper to receive and dispense notes intended for payouts.

11 Claims, 3 Drawing Sheets

U.S. PATENT DOCUMENTS 6,540,090 B1 * 4/2003 Sakai et al. ..... 209/534
6,929,109 B1 * 8/2005 Klein et al. ..... 194/206
6,959,800 B1 * 11/2005 Mazur et al. ..... 194/207
7,103,206 B2 * 9/2006 Graves et al. ..... 382/135
2002/0074267 A1 * 6/2002 Mukai ..... 209/534
2003/0118228 A1 * 6/2003 Mennie et al. ..... 382/135
2004/0011620 A1 * 1/2004 Molbak ..... 194/217

* cited by examiner

NOTE ACCEPTOR-DISPENSER VALIDATOR

FIELD OF THE INVENTION

The present invention relates to a currency acceptor and dispenser intended for use in electronic gaming machines, vending machines and the like.

BACKGROUND

In the early 1990's there was a fundamental change in the performance and capability of gaming machines initiated by the incorporation of bill acceptors into such machines. Bill acceptors are devices which receive paper currency or notes and, using a validator having both hardware and software components, the received currency or note is scanned with a variety of sensors and the sensor information is analyzed to determine (1) authenticity and (2) denomination of the currency or note from the scanned data. If the note is determined to be authentic currency, e.g. a United States $1, $5, $10, $20, $50 or $100 bill or other legal tender currency, the note is transported to a cash box within the bill acceptor for storage. Further, based upon the denomination of the accepted currency or note, a signal is sent from the validator to the host machine's controller or processor to cause the machine to accumulate a corresponding amount of credits within the machine's credit meter representing the cash value or credits available for purchasing products or wagering, in the case of a gaming machine. As the user purchases products from or plays the machine, the purchase price or wager is debited from the credit meter. In the case of a gaming machine, wins are either accumulated as credits or paid out in coins. Acceptors of this type are known and are discussed for example in U.S. Pat. No. 5,863,039 issued Jan. 26, 1999 to Suzuki.

Although the incorporation of bill acceptors into gaming machines has been a tremendous success for casinos, for example by increasing player retention and revenues, the success has proven to create certain unforeseen consequences. Casinos have had to adapt to accommodate a shift in employee resources as a result of the fact that up to eighty-five percent of the money received by a gaming machine, termed the "drop" in the industry, is now in the form of currency inserted into the bill acceptor as opposed to coins which have historically been used by customers to accumulate credits and used by the gaming machine to payout wins. This shift from the use of coins to currency by the customers has increased the personnel and logistical demands on the currency collection and counting rooms as well as creating fundamental shifts in how change booths and casino personnel operate. The net effect is that casinos have become. an organized note recycling system. Currency or notes go from the player into the bill acceptor of a gaming machine, from which they are periodically collected by a "drop crew" of casino employees and taken to a counting room where the currency is sorted and counted. From the counting room, a significant percentage of the currency or notes is delivered to change booths or floor cashiers for return back to the successful players in the form of change or payouts.

The incorporation of bill acceptors has thus caused a shift in the human resource requirements of casinos and slot machine managers. Although most of the currency or notes deposited into the gaming machines is received in the form of currency as opposed to coins, the predominant method of returning winnings to a customer for amounts less than a couple of hundred credits is in the form of coins or tokens from the machine coin hopper. In current slot machines, a "payout" condition is triggered when a player wishes to obtain a payout of the cash equivalent of the remaining accumulated credits on a gaming machine by depressing a "cash out" button, or the player obtains a large win requiring a "hand pay" by a floor cashier. For payouts in excess of a couple of hundred coins, the preferred method of payout is a hand pay where the patron receives currency from a casino employee or floor cashier. The combination of currency input and coin output from a gaming machine has caused a significant increase in the number of gaming machine coin hopper fills and hand pays the casino must handle. Major casinos may experience as many as 40,000 coin hopper fills and hand pays per month. This activity translates into increased employment expenses, since staff must be provided to service the coin hopper fills and hand pays as well as counting and sorting of the bills accepted by the machines, and thus increased overhead for the casinos.

Furthermore, when a large payout requiring a hand pay occurs, the gaming machine locks up or freezes until the amount is paid by the floor cashier and the machine is reset by the floor cashier. In addition, because the normal payout for relatively small numbers of coins is in the form of coins or tokens from the machine's coin hopper, the coin hopper must have its inventory of coins or tokens replenished by casino employees because the coin hopper is generally not receiving coins deposited by the customers who prefer to use currency accepted by the bill acceptor. Still further, a lock up condition may cause players to wait for a coin hopper to be refilled, or receive a hand pay, even for relatively small payouts if the coin hopper becomes fully depleted. While in a lock-up condition the machine is not available for play.

Since the utilization of the convenient bill acceptors has caused a dramatic shift in the drop received from a player from coins to currency or notes, it should be appreciated that the casino will need to retrieve the currency or notes received by the bill acceptors, and thus the cash boxes are periodically removed from the bill acceptors in the slot machines and taken to a counting room where the currency is removed and counted. Due to the volume of currency to be counted, this cyclic retrieval of the cash boxes and counting function can result in increased personnel costs as well as increased risk of theft. Accordingly, systems capable of combing the benefits of the bill acceptors and a more efficient method of payout reducing employee expenses and overhead would be tremendously beneficial to the gaming industry. In addition, other devices such as vending machines and pay-point service stations having bill acceptors and coin dispensers can suffer from similar or related problems, such as inability to provide change, running out of change and the like, and such devices could also benefit from an improved bill acceptor system.

SUMMARY OF THE INVENTION

The present invention is directed to a currency or note acceptor-dispenser validator and a method for its operation which is adapted to provide for faster payouts to, customers, which decreases the frequency of hand pay and machine lock up conditions and which is locally and remotely configurable to anticipate increased play periods or the like. Accordingly an acceptor-dispenser validator system for accepting bills, vouchers, script and/or currency (hereinafter, collectively "notes") into and for distributing currency or a currency equivalent from an electronic gaming machine or alternative type of customer service device is set forth which includes a note acceptor-dispenser assembly to be mounted in or on the machine, the note acceptor-dispenser having a note validator to sense the authenticity, denomination, amount and type of the note passing there through and issue a signal corresponding to the note type to the acceptor-dispenser's processor and the host machine's processor for accumulation of credits. A note box is provided to receive deposited notes, as is a note hopper to receive and dispense notes intended for payouts. There is also included means for transporting notes accepted through the note validator to each of the note box and note hopper and for distributing notes from the note hopper to the customer. The acceptor-dispenser's processor controls the transporting means to (i) direct notes received through the note validator of a selected type for accumulation of credits to said note hopper and the remainder to the note box for retention thereof and (ii) to control the transporting means to transport notes from the note hopper box and/or coin(s) from the machine coin hopper for distribution in response to a payout condition for the machine.

Thus, as notes (currency or casino script) are inserted through the note validator for accumulation of credits, certain specified notes, e.g. $20 bills or casino script notes, are transported to the note hopper to provide an inventory for dispensing the specified notes to the customer in response to a payout condition. Other note denominations, or the specified notes in excess of a pre-selected number of notes to be routed to the note hopper, are routed to the note box for accumulation and subsequent collection. The note box is periodically removed from the machine for counting of the notes. When a payout is required, the machine's processor signals the machine's coin hopper control, note hopper control and note hopper transport means to cause them to dispense a combination of coins and notes to the customer having a combined value equal to the amount of the payout. In this manner, the machine can provide a substantial payout to a customer in either currency or casino coupons without seriously depleting the number of coins in the coin hopper and without requiring a hand pay by a floor cashier.

The note acceptor-dispenser validator preferably has data processor capabilities, and the ability to communicate with the gaming machine's processor and any remote gaming machine accounting system to allow continuous monitoring and accounting and to confirm the payout to the customer if necessary. In addition, the accepter-dispenser validator's data processor may be locally (at the gaming machine) or remotely configured to accumulate more or fewer notes in the note hopper. Thus, in anticipation of a high utilization period, for example a busy weekend, the data processor may be instructed to cause the note accepter dispenser validator to accumulate more notes in the note hopper in anticipation of more frequent payouts to customers. Further, the data processor may be reconfigured or instructed to cause the gaming machine to inventory a different denomination of notes or currency in the note hopper or to only inventory certain notes such as casino script or the like.

DETAILED DESCRIPTION OF THE PREFERRED EMBODIMENTS

Figure 1:
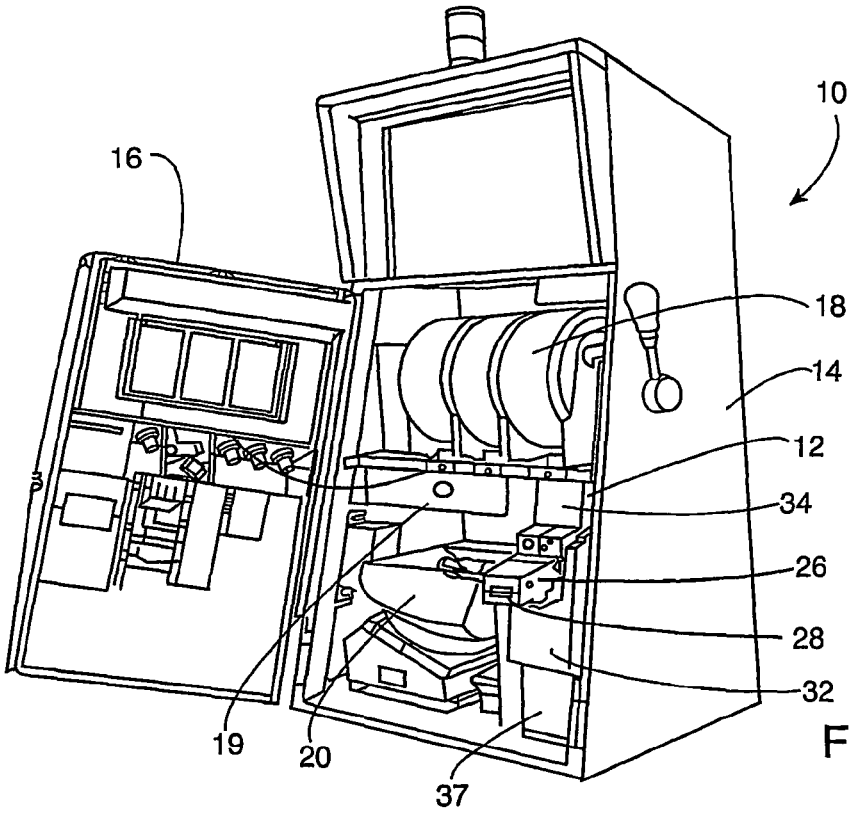
FIG. 1 shows a gaming machine including the note acceptor-dispenser validator which according to the present invention.

FIG. 1 shows a gaming machine 10 including the currency acceptor-dispenser validator 12 according to the present invention. While the gaming machine 10 is shown as an electrical mechanical, reel-type slot machine, it is to be understood that the present invention could be used on any gaming machine which receives wagers and pays out based upon play, such as slot machines, video slot or poker machines, video keno machines and the like. The present invention can also be used in vending machines and pay point machines, where a combination of currency and change may be required to be paid out to customers. For purposes of detailing the invention, however, the description herein is tailored to the application of the invention in a gaming machine.

Figure 3:
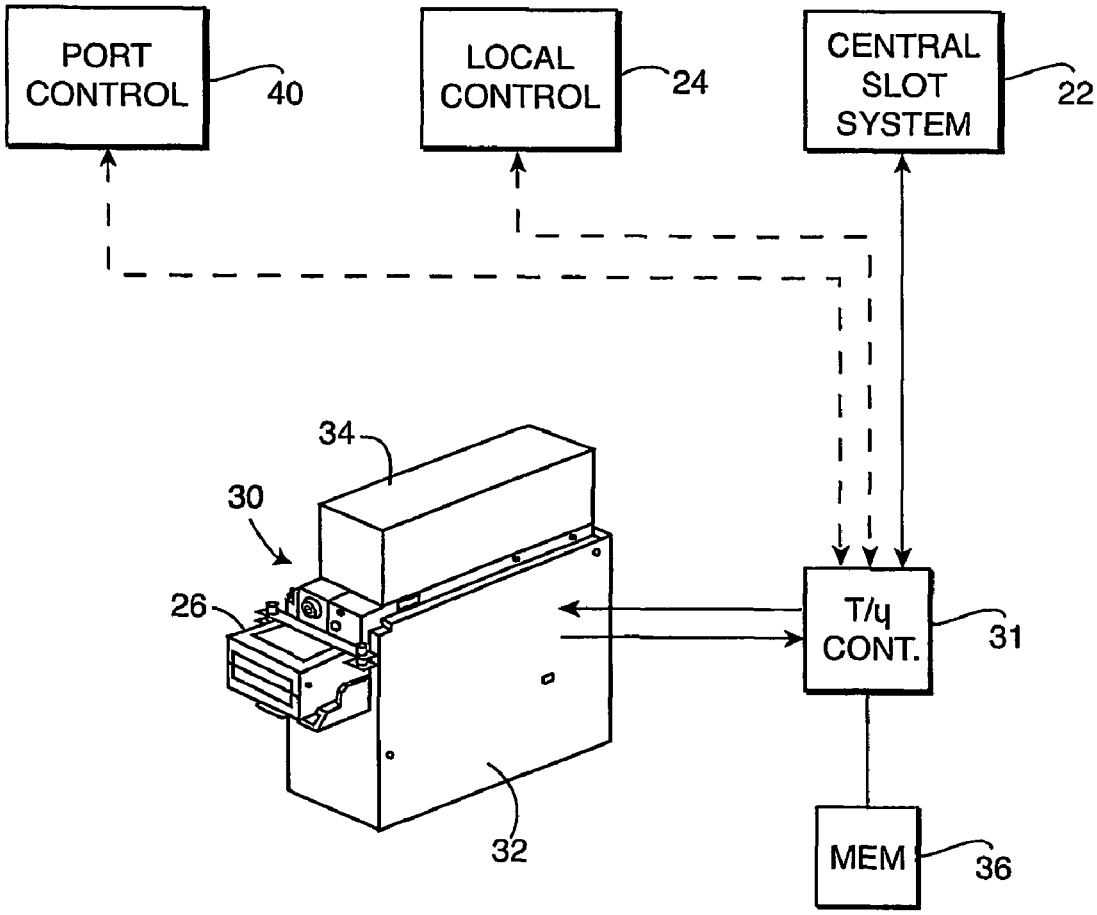
FIG. 3 illustrates the control system configuration of the acceptor-dispenser validator according to the present invention.

The gaming machine 10 generally includes a housing 14 of various potential configurations designed to contain the various components of such machines. The interior of the gaming machine 10 may normally be accessed through opening a front cover or door 16. Disposed within the housing 14 are the reels 18 for the play of the game, a central processing unit (CPU) 19 which controls the operation of the gaming machine 10, as well as a coin hopper assembly 20 adapted to receive, hold and dispense coins or tokens in a known fashion. As is known in the industry, the CPU 19 controls the operation of the gaming machine 10. The CPU 19 controls the selection of the outcome, monitors the amount wagered for each play or "hand," determines winning payouts to the player, monitors the accumulation of credits at the gaming machine available for play and the like. These features, which are controlled by the CPU 19, are now well-known in the art. To monitor the performance and operation, the CPU 19 of each gaming machine 10 in a casino may be in communication with a centralized system server 22 (FIG. 3). The system server 22 monitors the revenue or coin-in amounts wagered, amounts paid out and the like for each gaming machine 10 in the casino. A communication network for multiple gaming machines 10 in a casino may include local controllers 24 which store data for a group of gaming machines 10 for periodic polling by the centralized system server 22.

To play a gaming machine 10, a player inserts tokens, coins, bills, currency, script or coupons, which are tested and if valid are accumulated as credits for gaming. The received coins or tokens are directed to the coin hopper assembly 20 for storage or the coins/tokens may be directed to an auxiliary collection location, for example under the machine. Alternatively, to amass credits for play of the gaming machine 10, the gaming machine 10 may be provided with a currency validator which receives notes as legal tender or script and, based upon the note's value, assigns a corresponding value of credits within the gaming machine 10 for gaming. Known validators, according to the prior art, are adapted only to receive, validate and store notes. Accordingly, if a player wishes to cash out the accumulated credits or wins a jackpot, the amount must be dispensed from the coin hopper assembly 20 or an attendant must make what is known as a hand pay.

According to the present invention, the acceptor-dispenser validator 12 may be disposed in the housing 14 of the gaming machine 10, and electrically connected to the CPU 19 therein. Preferably, the acceptor-dispenser validator 12 is of a size and configuration to be received within the housing 14 at the location previously occupied by prior validating devices so that no extensive reconfiguration or redesign of the gaming machine 10 is required. Alternatively, some or all of the acceptor-dispensor validator 12 could be mounted on the outside of the housing 14.

Figure 2:
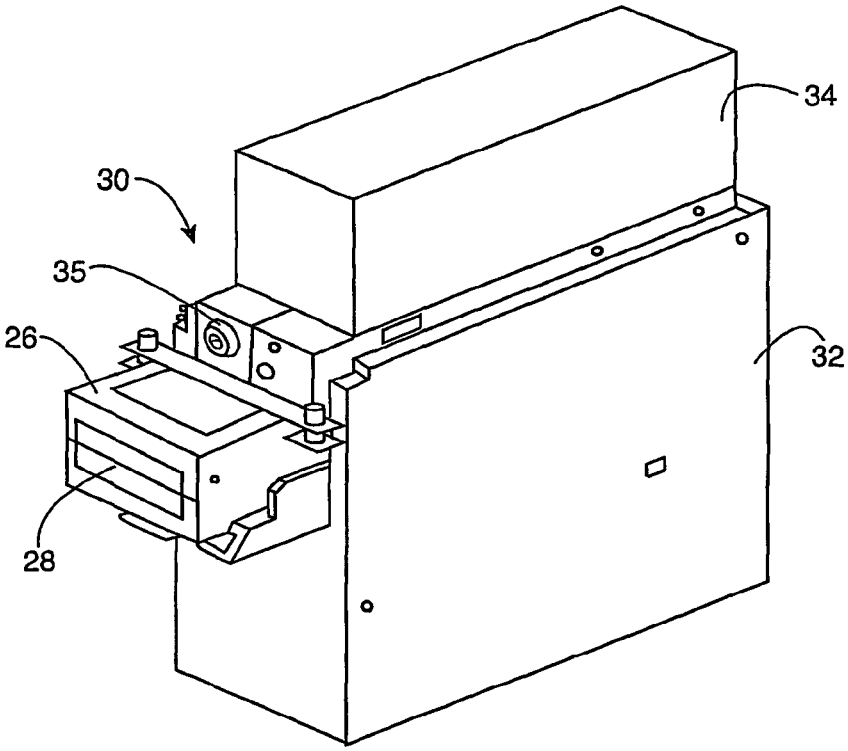
FIG. 2 shows a perspective view of the note acceptor-dispenser validator including the note box and note hopper assembly according to the present invention.

The acceptor-dispenser validator 12, as shown in FIG. 2, includes a validator head 26 adapted to scan a note inserted into an opening 28 to determine the authenticity, type (legal tender or script, if required), denomination and condition (whether the note is worn) of the note. Typically the note is inserted into the opening 28 and is captured and transported by a transportation unit 30 past optical and magnetic sensors (not shown) which may, for example, sense light reflected by and/or transmitted through the note, reflectivity and transmission patterns, size of the note and the magnetic characteristics of the inserted note. The various sensors output sensed data output signals which are compared by a validator processor (not shown) to stored data representative of the range of sensor readings corresponding to authentic notes.

If the note is determined valid and authentic, based on the comparison with the stored data for authentic notes, the transportation unit 30 transports the note to one of a note box 32 or a note hopper 34 for storage. Also, upon receipt and determination of validity, a signal is sent to the slot machine CPU 19 signifying receipt as well as the denomination of the note for accumulation of a like value amount of credits in the slot machine 10 for gaming. If the note is not determined valid, the transportation unit 30 is reversed and the note is ejected through the opening 28 to the customer.

The note box 32 is preferably positioned below the transportation unit 30, as shown in FIG. 2. The note hopper 34 may be positioned above the transportation unit 30 to take advantage of open space in many existing game machines, however the note hopper can be stacked above, behind or below the note box 32, both of which may be either above or below the transportation unit 30. The note hopper 34 and note box 32 are secured to the transportation unit 30 to form the acceptor-dispenser validator 12. To prevent theft of notes during service of the gaming machine 10, the attachment of the note box 32 may include a locking mechanism which opens the note box 32 to allow receipt of notes from the transportation unit 30 only when the note box 32 is locked to the dispenser 12. When the note box 32 is unlocked for removal from the dispenser 12, the locking means closes the note box 32 to prevent removal of notes stored therein. Another lock (not shown) is provided on the note box 32 for opening of the note box 32 at the casino counting room for removal of the stored notes and counting thereof.

The notes received into the note box 32 are typically stacked in a vertical relationship and accordingly the note box 32 has a configuration corresponding to the plan dimensions of the notes. The acceptor-dispenser 12 according to the present invention also includes the note hopper 34 adapted to receive and store notes in a stacked relationship. A locking assembly 35 may be provided for locking the note hopper 32 to the acceptor-dispenser 12 to prevent theft of notes, as well as to allow locking of the note box 32 during transport from the gaming machine 10 to the counting room. The transport unit 30 is adapted to move notes through the validator head 26 to a selected one of the note box 32 or note hopper 34. To control the transportation unit 30, the acceptor-dispenser 12 includes a transportation unit controller 31 (FIG. 3), which is in communication with the validator head 26 as well as the slot machine CPU 19 and potentially a central slot server 22. Motorized means within the transportation unit 30 such as motorized traction wheels, belts, conveyers and gates, under control of the transportation unit controller 31 selectively move the notes accepted as being valid.

The transportation unit controller 31 also includes a data structure or memory 36 (FIG. 3) storing data concerning the notes stored in the note hopper 34 including at least data corresponding to the number of notes stored in the note hopper 34. Similarly, the transportation unit controller 31 and memory 36 preferably has the ability to store data concerning the number and type of notes stored in the note box 32. Moreover, the transportation unit controller 31 and memory 36 associated therewith optimally can also provide status and activity information, including for example dispensing or accepting status, fault conditions, any "note hopper empty" condition, a note hopper or transportation unit jam or a note hopper absence condition. It may also be beneficial to have memory devices, such as contact memory devices known in the art, integral with the note hopper 34 and the note box 32, such memory devices being configured to receive data from the unit controller 31 concerning the status of the notes which should be present in the respective device. All of the data available in the memory 36 may be remotely accessible from the transportation unit controller 31 by the gaming machine's CPU 19 and potentially the central slot server 22.

The gaming machine 10 may also include an associated printer 37, which may operate in combination with the note acceptor-dispenser 12. The printer 37 can be configured to print one or more cash-out tickets or coupons that have a value assigned by the unit controller 31. Such a printer 37 can also be configured to dispense the cash-out tickets or coupons using the transportation unit 30, or alternatively the printer may dispense the cash-out tickets through a slot (not shown) on the front of the gaming machine 10.

Figure 4:
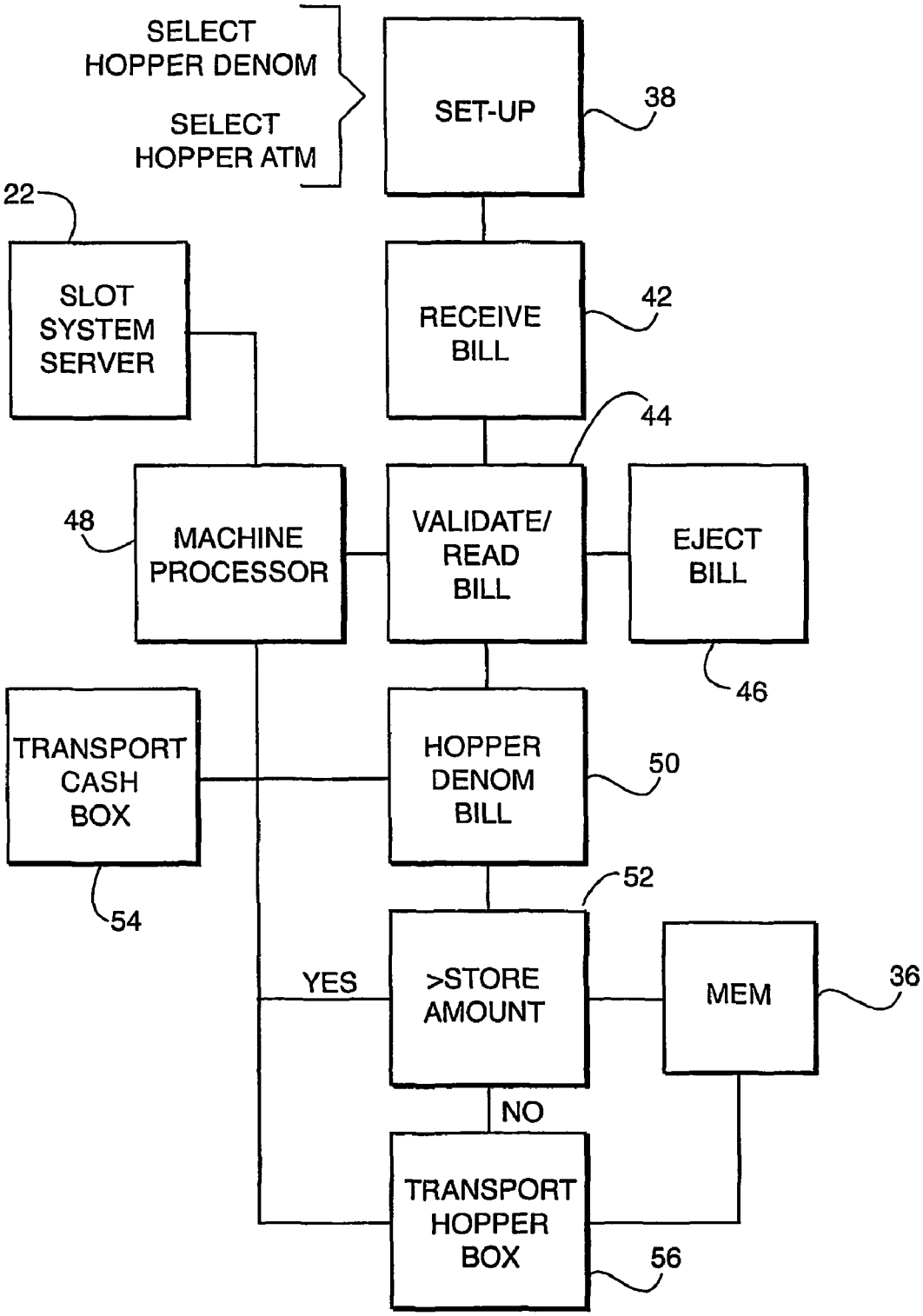
FIG. 4 is a logic diagram showing the note validation and note storing dispensing features of the control system for operating the system according to the present invention.

With reference to FIGS. 3 and 4, the logic of the operation of the acceptor-dispenser 12 and method of the present invention is illustrated using block diagrams. The transportation unit controller 31 (FIG. 3) is first configured in the block diagram of FIG. 4 during a set up procedure, shown by box 38, to select the denomination/type of note to be sent to and stored in the note hopper 34 as well as the selected number of notes to be routed to and stored therein. The configuration at set up 38 may be by a command or series of commands from the central slot server 22, at the local controller 24 or by a portable, hand-held device 40 to be coupled to and in communication with the transportation unit controller 31 and slot machine CPU 19 as shown in FIG. 3. The configuration or set up at 38 of the acceptor-dispenser 12 may also include input of data into the transportation unit memory 36 of data corresponding to the number of notes pre-loaded into the hopper box 34 for dispensing thereof in the manner described below.

As an example of how the acceptor-dispenser 12 may be operated, the transportation unit controller 31 may be configured to store a minimum of 60 to 200 notes in the note hopper 34 with a beginning inventory of 66 such notes. The number, denomination or type of note and starting inventory can be selectively changed to store another denomination or type, or to store script notes only, store only less worn notes or any combination thereof. These instructions, may be, as stated above, downloaded from the central slot system server 22, CPU 19 or another local controller 24 or by a portable controller 40.

Once instructed, the transportation unit controller 31 controls the transportation unit 30 to deliver newly received notes accepted by the validator and meeting the preset criteria to the note hopper 34, until instructed otherwise. For example, in anticipation of more frequent payouts, the transportation unit controller 31 may be instructed to store a minimum of one hundred notes and up to a maximum of four hundred notes depending upon the anticipated number and frequency of payouts. More specifically, in anticipation of high holiday weekend play, the number of notes to be stored in the note hopper 34 defining an inventory for dispensing for payouts and cash outs can be increased to the maximum, for example, four hundred notes, simply by sending an instruction to the transportation unit controller 31. Additionally or alternatively, the note hopper 34 may be loaded with a significant inventory of notes in anticipation of increased play.

To play the slot machine 10, a player initiates play at step 42 by inserting a note into the validator head opening 28. The note is transported through the validator to scan the note. Data from the validator's sensors is transmitted to the machine processor 48, which, at step 44, compares the data to stored data to determine the note's authenticity, denomination, type and condition. If the note is not determined to be authentic, transportation unit controller 31 rejects the note at step 46 and controls the transportation unit 30 to reverse the direction of the drive transport and thereby expel the note through the opening 28 and back to the customer. If the note is determined to be authentic, the denomination or value of the note is transmitted by the machine processor 48 to the CPU 19, and potentially also to the system server 22. As discussed above, the CPU 19 stores a corresponding value amount of credits in the gaming machine 10 for gaming. The data is also compared within the transportation unit controller 31 to determine at 50 if the note is of a type, denomination and condition selected for storage in the note hopper 34. If it is, the transportation unit controller 31 at step 52 further interrogates the transportation unit memory 36 to determine if the maximum storage number of notes to be stored in the note hopper 34 has been met. If the number of notes in the note hopper 34 is less than the instructed maximum number, the note is routed to the note hopper 34 at step 56. If the maximum number of notes in the note hopper 34 has already been stored in the note hopper 34, the transportation unit controller 31 controls the transportation unit 30 to transport the received note at step 54 to the note box 32.

When a note is transported to the note hopper 34, the transportation unit memory 36 is updated to indicate that a note has been added to the note hopper 34. Thus, the transportation unit memory 36 keeps a rung total of the number of notes stored in the note hopper 34 to preferentially maintain a pre-selected number of notes to be stored therein. When a pre-selected maximum number of notes to be stored in the note hopper 34 has been met, additional notes, even though they may be of the denomination, type and condition which would normally be stored in the note hopper 34, are sent to the note box 32 for storage. If the validated note is not of the pre-selected type to be stored in the note hopper 34 the transportation unit 31 is instructed at step 54 to send the note to the note box 32.

When a player hits a jackpot or wishes to cash out their accumulated credits, an appropriate instruction is sent to the machine CPU 19 and potentially also to the central slot server 22. The machine CPU 19 calculates the payout as a combination of coins/tokens and the appropriate number of notes of the specified note denomination stored in the note hopper 34. Alternatively, a portion or all of the payout could be made in the form of cash out tickets printed by the printer 37.

If the payout is less than the stored note denomination, the payout is made exclusively from the coin hopper assembly 20 to the player and coins/tokens are dispensed. If the payout can include a stored denomination note, e.g. where the gaming machine 10 is a twenty-five cent denomination machine, the denomination of notes stored in the note hopper 34 is twenty dollar notes and the payout is greater than eighty credits, the calculation is made by the CPU 19 and the combination of notes to be dispensed from the note hopper 34 and coin/tokens to satisfy that payout is made. The machine CPU 19 controls the coin hopper assembly 20 to dispense the requisite number of coin\tokens derived from the calculation for the payout and sends an instruction to the transportation unit controller 31 to control the transportation unit 30 to sequentially retrieve one or more notes from the note hopper 34 for dispensing.

Under instruction from the CPU 19, the transportation unit controller 31 controls the transportation unit 30 to serially retrieve and transport the required number of notes from the note hopper 34 through the validator head 26 for dispensing through the opening 28 for the payout. In this process, as a note is dispensed, the validator head 26 senses the note and sends a signal to the machines CPU 19 and transportation unit controller 31 to account for the dispensing of the note for the payout. To prevent notes from stacking one behind the other, the validator head 26 also senses the removal of the note from the opening 28 by the customer before an instruction is sent to the transportation unit controller 31 to dispense another note. As notes are dispensed, the transportation unit memory 36 is updated and the number of dispensed notes is deducted. Thus the transportation unit memory 36 keeps a running tally of notes stored in the note hopper 34. Further as notes are dispensed, the gaming machine's CPU 19 accounts for the dispensing of notes and coin/tokens until the payout is complete, the data corresponding to the payout may also be sent to the central slot system 22 for accounting purposes.

The acceptor-dispenser 12 preferably has the capability of monitoring the number of notes in the note hopper 34, the status of the note hopper 34 and the status of the transportation unit 30. Thus, the system can determine or detect when all notes are depleted from the note hopper 32 and any jamming of notes in the note hopper 34 or transportation unit 30. It may be beneficial to include a security protocol, for example a password or encryption system, to limit access to the unit controller's program so that the system cannot be changed so as to store or dispense a different denomination of note from the note hopper 34 absent proper authorization. As another security feature, the controller can be programmed so as to preclude any change being made to the denomination of note to be directed to the note hopper 34 if there are any notes in the note hopper 34. Further, the controller is preferably programmed to allow control over the maximum number of notes dispensed on a payout and the maximum number of notes that can be dispensed in a specified amount of time. This feature is important as casinos may be limited on the maximum amount of a single payout which may be made, and to prevent abuse or laundering of money using the gaming machine.

As can be appreciated, the note acceptor-dispenser and method of the present invention provide several benefits. One benefit is that it reduces the amount of floor staff required to service the gaming machines by requiring fewer coin/token hopper refills and fewer lockups of the machines heretofore required for hand pay jackpots. Another advantage is that the invention reduces the number of notes which have to be counted in the counting room in that notes are dispensed back to players as jackpots or cash outs. Another feature is that players can quickly receive payouts and thus the system provides more convenience to the players. As another advantage, the note acceptor-dispensers can be re-configured to minimize or maximize the number of notes stored in the hopper box based upon various concerns such as greater or less frequency of play, cash demands and the like.

The present invention can also be used for vending machines at gasoline service stations and the like where change may be required to be dispensed back to customers. Heretofore, vending machines have typically dispensed all change as coins thus requiring re-filling and servicing of coin hoppers. By providing the note acceptor-dispenser according to the present invention, notes, such one dollar notes, can be inventoried in a hopper to be dispensed as change reducing the requirements for filling of change hoppers and the like.

As an example of an alternative embodiment of the contemplated invention which would be readily apparent to those skilled in the art following review of the foregoing detailed description, the notes dispensed by the dispensers may be provided through a second opening, distinct and spaced apart from the opening which receives notes to be scanned by the validator. Such an arrangement would have the benefit of decreasing the wear on the validator head units. Accordingly, when a note is to be dispensed, the transportation unit would transport the note to the second opening for dispensing to a customer.

While we have shown and described certain embodiments of the present invention, it is to be understood that it is subject to many modifications and changes without departing from the spirit and scope of the appended claims.

The invention claimed is:

1. A note acceptor-dispenser for a vending machine comprising:

a note validator having an opening configured to receive notes and a validator head configured to sense data relating to authenticity, denomination, and type of each note inserted into said opening and to generate signals corresponding to sensed data for each received note;

a validator processor configured to receive and compare said sensed data signals with stored data to validate authenticity of said received notes and to generate a credit signal signifying receipt and denomination of each received note determined to be authentic to a controller for the vending machine;

a note hopper/dispenser configured to receive and store at least some pre-selected characteristic notes received by said note validator and determined to be authentic by said validator processor;

a note box configured to receive and hold all remaining notes received by said note validator and determined to be authentic by said validator processor;

a transportation unit configured to direct received, authenticated notes to one of said note box and said note hopper/dispenser based upon (a) pre-selected characteristics, including at least denomination of the received, authenticated notes and (b) minimum and maximum numbers of notes having a first denomination, directing notes having said first denomination to be stored in said note hopper/dispenser until said note hopper/dispenser contains said maximum number of notes of said first denomination, directing notes having said first denomination to be stored in said note box if said note hopper/dispenser contains said maximum number of notes of said first denomination, and directing all notes having a denomination other than said first denomination to be stored in said note box, and to dispense notes from said note hopper/dispenser out of said opening in response to a signal received by said note acceptor-dispenser from said controller for the vending machine;

a controller configured to control operation of the note acceptor-dispenser, said note acceptor-dispenser controller being capable of changing the pre-selected characteristics used for directing notes to said note hopper/dispenser and maintaining a running accounting of a number and denominations of the notes contained in each of said note hopper/dispenser and said note box, wherein said note acceptor-dispenser controller is configured to receive instructions from a remote controller external to the note acceptor-dispenser to reprogram the minimum and maximum numbers of said first denomination notes to be stored in said note hopper/dispenser.

2. The note acceptor-dispenser of claim 1 wherein said validator head is configured to sense data relating to a condition of notes inserted into said opening and said note acceptor-dispenser controller is configured to reprogram selection criteria concerning a maximum worn condition of said pre-selected characteristic notes to be stored in said note hopper/dispenser.

3. The note acceptor-dispenser of claim 1 wherein said note acceptor-dispenser controller is configured to securely reprogram selection criteria concerning the pre-selected characteristic notes to be stored in said note hopper/dispenser.

4. The note acceptor-dispenser of claim 1, wherein said vending machine further includes a coin hopper and a coin dispenser, and wherein said note acceptor-dispenser controller is configured to calculate a number of notes to be dispensed from said note hopper/dispenser and a number of coins to be dispensed from said coin hopper to provide a combination of notes and coins to total an amount to be dispensed as specified by said controller of the vending machine.

5. The note acceptor-dispenser of claim 1, further comprising:

a sensor configured to sense removal of notes dispensed by said transportation unit from said opening, wherein said note acceptor-dispenser controller is configured to await removal of a dispensed note before an instruction is sent to dispense another note from said note hopper/dispenser.

6. The note acceptor-dispenser of claim 1, wherein said note acceptor-dispenser controller is configured to limit an amount of payout from said note hopper/dispenser as change for a vend transaction.

7. A note acceptor-dispenser for a vending machine comprising:

a note validator having an opening configured to receive notes and a validator head configured to sense data relating to authenticity, denomination, and type of each note inserted into said opening and to generate credit signals corresponding to sensed data for each received note;

a validator processor configured to receive and compare said sensed data signals with stored data to validate authenticity of said received notes and to generate a signal signifying receipt and denomination of each received note determined to be authentic to a controller for the vending machine;

a note hopper/dispenser configured to receive and store at least some pre-selected characteristic notes received by said note validator determined to be authentic by said validator processor;

a note box configured to receive and hold notes received by said note validator and determined to be authentic by said validator processor;

a transportation unit configured to direct received, authenticated notes to one of said note box and said note hopper/dispenser based upon pre-selected characteristics, including denomination, of the received, authenticated notes, and to dispense notes from said note hopper/dispenser out of said opening in response to a signal received by said note acceptor-dispenser from said controller for the vending machine;

a controller configured to control operation of the note acceptor-dispenser, said note acceptor-dispenser controller being capable of changing the pre-selected characteristics used for directing notes to said note hopper/ dispenser and to securely reprogram selection criteria concerning the pre-selected characteristic notes to be stored in said note hopper/dispenser, wherein said reprogramming said note acceptor-dispenser controller is prohibited from changing the denomination of pre-selected characteristic notes to be stored in said note hopper/dispenser by said transportation unit whenever said note hopper/dispenser is not empty.

8. The note acceptor-dispenser of claim 7, wherein said note acceptor-dispenser controller is configured to limit an amount of payout from said note hopper/dispenser as change for a vend transaction.

9. The note acceptor-dispenser of claim 6 wherein said vending machine further includes a coin hopper and a coin dispenser, and wherein said note acceptor-dispenser controller is configured to calculate a number of notes to be dispensed from said note hopper/dispenser and a number of coins to be dispensed from said coin hopper to provide a combination of notes and coins to total an amount to be dispensed as specified by said controller of the vending machine.

10. The note acceptor-dispenser of claim 7, further comprising:

a sensor configured to sense removal of notes dispensed by said transportation unit from said opening by a customer, wherein said note acceptor-dispenser controller is configured to await removal of a dispensed note before an instruction is sent to dispense another note from said note hopper/dispenser to said opening.

11. A note acceptor-dispenser validator, comprising:

a note validator having an opening for receiving notes and a validator head including a sensor configured to sense data relating to the authenticity, denomination, and type of note inserted into said validator and configured to generate signals corresponding to the sensed data for each received note;

a validator processor configured to receive and compare said sensed data signals with stored data to validate the authenticity of said notes and for generating a credit signal signifying receipt and a denominational value of said note to a host machine;

a note hopper/dispenser disposed within said note acceptor-dispenser validator configured to receive and store at least some authentic pre-selected characteristic notes received by said note acceptor-dispenser validator;

a lockable and removable note box configured to receive and securely hold all notes received by said note acceptor-dispenser validator which are not routed to said note hopper/dispenser;

a transportation unit configured to direct said notes determined to be authentic to one of said lockable and removable note box and said note hopper/dispenser and for dispensing notes from said note hopper/dispenser out of said opening of said note acceptor-dispenser validator in response to a signal received by said note acceptor-dispenser validator from said host machine;

a controller configured to control the operation of the note acceptor-dispenser validator, said controller configured to change the characteristic used for directing notes to said note hopper/dispenser and to maintain a running accounting of the number and denominations of the notes contained in each of said note hopper/dispenser and said note box, wherein said controller further comprises means for receiving instructions from said host machine for reprogramming selected criteria concerning said pre-selected characteristics of said notes desired to be stored in said note hopper/dispenser based on said received instructions.

* * * * *